US010829997B2

(12) United States Patent
Morin

(10) Patent No.: US 10,829,997 B2
(45) Date of Patent: Nov. 10, 2020

(54) EARTH-BORING TOOLS INCLUDING SEPARABLE BEARING ASSEMBLIES FOR MOUNTING ROLLER CONES TO SUCH TOOLS

(71) Applicant: Baker Hughes, a GE company, LLC, Houston, TX (US)

(72) Inventor: John Morin, The Woodlands, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 180 days.

(21) Appl. No.: 15/915,178

(22) Filed: Mar. 8, 2018

(65) Prior Publication Data

US 2019/0277093 A1 Sep. 12, 2019

(51) Int. Cl.

| | |
|---|---|
| ***E21B 10/22*** | (2006.01) |
| ***E21B 10/14*** | (2006.01) |
| *E21B 10/25* | (2006.01) |
| *E21B 10/56* | (2006.01) |

(52) U.S. Cl.

CPC ..... *E21B 10/22* (2013.01); *E21B 10/14* (2013.01); *E21B 10/25* (2013.01); *E21B 10/56* (2013.01)

(58) Field of Classification Search

CPC ..... E21B 10/22; E21B 10/14; E21B 10/25; E21B 10/56; E21B 2010/225

See application file for complete search history.

(56) References Cited

U.S. PATENT DOCUMENTS

| | | | | |
|---|---|---|---|---|
| 2,168,737 | A * | 8/1939 | Mackey | A47J 43/282 425/281 |
| 2,787,502 | A | 4/1957 | Huckshold | |
| 3,998,500 | A * | 12/1976 | Dixon | E21B 10/18 384/96 |
| 4,738,322 | A | 4/1988 | Hall et al. | |
| 8,950,515 | B2 * | 2/2015 | Schroder | E21B 10/22 175/359 |
| 8,955,622 | B2 | 2/2015 | Schroder | |
| 2013/0105229 | A1 | 5/2013 | Schroder | |
| 2015/0152687 | A1 | 6/2015 | Nguyen et al. | |

(Continued)

OTHER PUBLICATIONS

International Search Report for International Application No. PCT/US2019/021289 dated Jun. 20, 2019, 3 pages.

(Continued)

*Primary Examiner* — Yong-Suk Ro

(74) *Attorney, Agent, or Firm* — TraskBritt

(57) ABSTRACT

An earth-boring tool for removing subterranean formation material in a borehole comprises a tool body having a central axis defining an axial center thereof and a leg extending in an axial direction from the tool body. A bearing assembly is removably coupled to the leg and includes a bearing shaft and a base member. The base member encircles a portion of the bearing shaft and abuts against a surface of the leg. A roller cone is rotatably coupled to the bearing assembly and has a rotational axis about which the roller cone rotates on the bearing assembly when the roller cone removes subterranean formation material in the borehole. A method of assembling a rotatable cutting structure assembly including the bearing assembly includes coupling the bearing shaft to the leg by disposing a mechanical fastener through an aperture formed through the leg and into a cavity of the bearing shaft.

20 Claims, 6 Drawing Sheets

(56) References Cited

U.S. PATENT DOCUMENTS

| | | | |
|---|---|---|---|
| 2015/0337603 | A1 | 11/2015 | Schroder |
| 2017/0122036 | A1 | 5/2017 | Kulkarni |
| 2017/0241208 | A1 | 8/2017 | Bomidi et al. |
| 2017/0241209 | A1 | 8/2017 | Benes |

OTHER PUBLICATIONS

International Written Opinion for International Application No. PCT/US2019/021289 dated Jun. 20, 2019, 6 pages.

* cited by examiner

EARTH-BORING TOOLS INCLUDING SEPARABLE BEARING ASSEMBLIES FOR MOUNTING ROLLER CONES TO SUCH TOOLS

FIELD

Embodiments of the present disclosure relate generally to earth-boring tools for use in drilling operations in subterranean formations. More particularly, the disclosure relates to earth-boring tools including rotatable cutting structures and bearing assemblies thereof.

BACKGROUND

Drill bits are frequently used in the oil and gas exploration and recovery industry to drill well bores (also referred to as "boreholes") in subterranean earth formations. Two common classifications of drill bits used in drilling well bores are fixed-cutter or drag drill bits and roller cone drill bits. Fixed-cutter drill bits generally include a bit body having an externally threaded connection at one end for connection to a drill string, and a plurality of fixed blades extending from the opposite end of the bit body. The blades form the cutting surface of the drill bit and have a plurality of cutting elements mounted thereon. The cutting elements may include polycrystalline diamond compact (PDC) cutting elements or other materials and are used to cut through a subterranean formation during drilling operations when the fixed-cutter drill bit is rotated by a motor or other rotational input device.

Roller cone drill bits generally include a bit body with an externally threaded connection at one end, and a plurality of roller cones (typically three) attached at an offset angle to the other end of the drill bit. These roller cones are able to rotate about bearings, and rotate individually with respect to the bit body. These roller cones may have cutting elements mounted thereon that are used to gouge and crush the subterranean formation during drill operations when the roller cone drill bit is rotated by a motor or other rotational input device.

Another type of earth-boring drill bit referred to in the art as a "hybrid" drill bit combines fixed blades and rolling cones on the bit body. The hybrid drill bit is designed to overcome some of the limiting phenomena of drag drill bits and roller cone drill bits, such as balling, reducing drilling efficiency, tracking, and wear problems. Roller cones of the hybrid drill bit are mounted to axially extending bit legs. The bit legs are generally removably fastened to the drill bit body such as by mechanically fastening the legs to the bit body as described, for example, in U.S. Pat. Pub. No. 2015/0337603, titled "Hybrid Bit with Mechanically Attached Roller Cone Elements," filed May 22, 2015, and/or by welding the legs to the bit body as described, for example, in U.S. Pat. Pub. No. 2015/0152687, titled "Hybrid Drill Bit Having Increased Service Life," filed Jan. 30, 2015, the disclosure of each of which is incorporated herein in its entirety by this reference.

BRIEF SUMMARY

In some embodiments, an earth-boring tool for removing subterranean formation material in a borehole comprises a tool body having a central axis defining an axial center thereof and a leg extending in an axial direction from the tool body. A bearing assembly is removably coupled to the leg and includes a bearing shaft and a base member. The base member encircles a portion of the bearing shaft and abuts against a surface of the leg. A roller cone is rotatably coupled to the bearing assembly and has a rotational axis about which the roller cone rotates on the bearing assembly when the roller cone removes subterranean formation material in the borehole.

In other embodiments, a rotatable cutting structure assembly comprises a bearing assembly separable from a tool body of an earth-boring tool. The bearing assembly comprises a bearing shaft and a base member separable from the bearing shaft and encircling a portion of the bearing shaft. A roller cone is rotatably coupled to the bearing assembly and has a rotational axis about which the roller cone rotates on and about the bearing assembly.

In yet other embodiments, a method of assembling a rotatable cutting structure assembly on an earth-boring tool comprises abutting a base member of a bearing assembly against a planar interior surface of a leg extending from a tool body. The base member comprises an aperture extending therethrough. The method further includes disposing at least a portion of a bearing shaft of the bearing assembly within the aperture of the base member. The bearing shaft comprises a cavity formed therein. The bearing shaft is coupled to the leg by disposing a mechanical fastener through an aperture formed through the leg of the tool body between an exterior surface and the interior surface thereof and into the cavity of the bearing shaft. A roller cone is disposed on the base member and the bearing shaft.

BRIEF DESCRIPTION OF THE DRAWINGS

While the specification concludes with claims particularly pointing out and distinctly claiming embodiments of the present disclosure, the advantages of embodiments of the disclosure may be more readily ascertained from the following description of embodiments of the disclosure when read in conjunction with the accompanying drawings in which:

DETAILED DESCRIPTION

Figure 1:
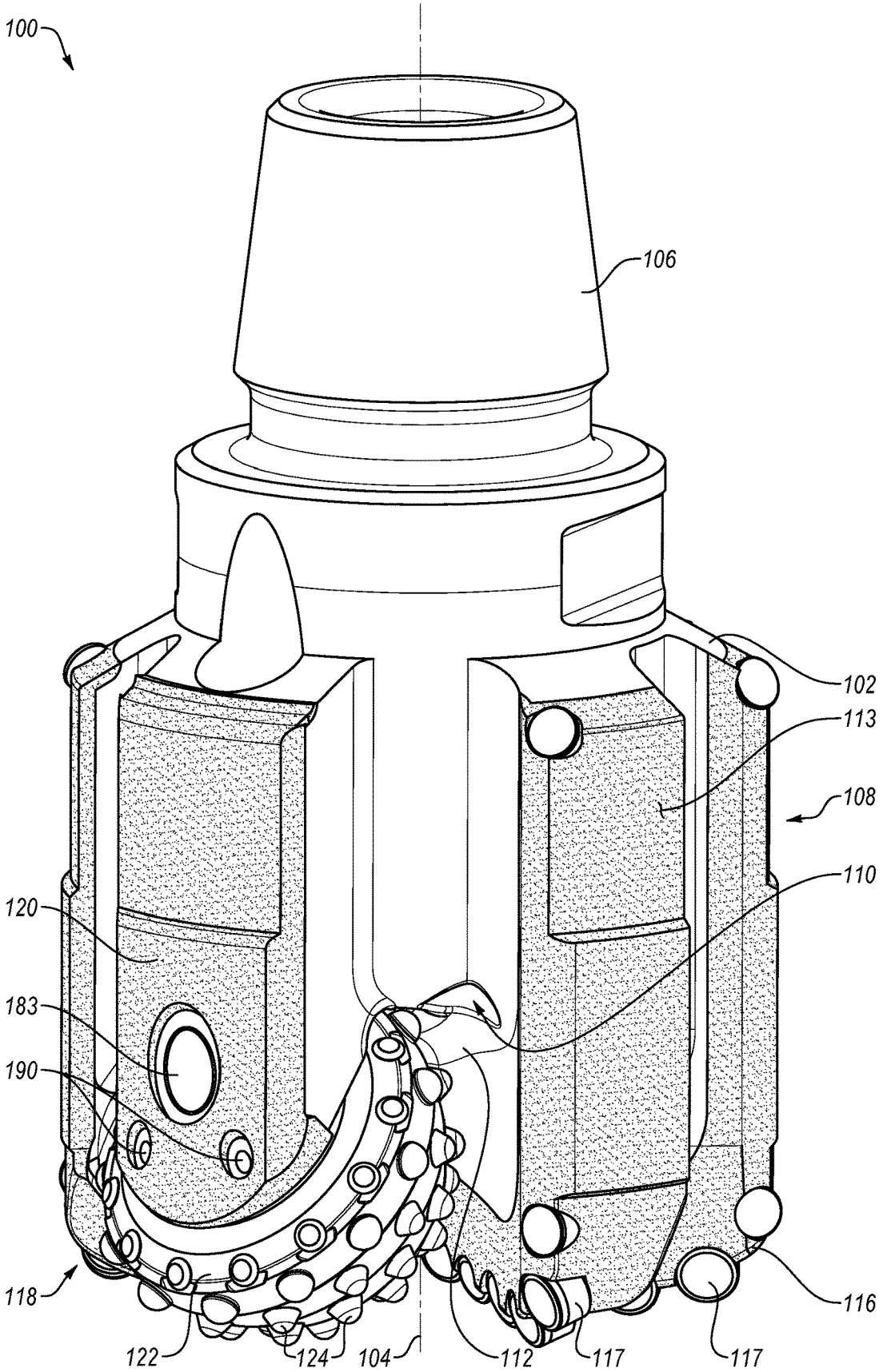
FIG. 1 illustrates an earth-boring tool according to embodiments of the present disclosure, which includes a roller cone bearing assembly as disclosed herein.

The illustrations presented herein are not actual views of any particular earth-boring tool, rotatable cutting structure assembly, bearing assembly, or any component thereof, but are merely idealized representations employed to describe example embodiments of the present disclosure. The following description provides specific details of embodiments of the present disclosure in order to provide a thorough description thereof. However, a person of ordinary skill in the art will understand that the embodiments of the disclosure may be practiced without employing many such specific details. Indeed, the embodiments of the disclosure may be practiced in conjunction with conventional techniques employed in the industry. In addition, the description provided below does not include all elements to form a complete structure or assembly. Only those process acts and structures necessary to understand the embodiments of the disclosure are described in detail below. Additional conventional acts and structures may be used. Also note, any drawings accompanying the application are for illustrative purposes only, and are thus not drawn to scale. Additionally, elements common between figures may have corresponding numerical designations.

As used herein, the terms "comprising," "including," "containing," "characterized by," and grammatical equivalents thereof are inclusive or open-ended terms that do not exclude additional, unrecited elements or method steps, but also include the more restrictive terms "consisting of" and "consisting essentially of" and grammatical equivalents thereof.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features and methods usable in combination therewith should or must be excluded.

As used herein, the term "configured" refers to a size, shape, material composition, and arrangement of one or more of at least one structure and at least one apparatus facilitating operation of one or more of the structure and the apparatus in a predetermined way.

As used herein, the singular forms following "a," "an," and "the" are intended to include the plural forms as well, unless the context clearly indicates otherwise.

As used herein, the term "and/or" includes any and all combinations of one or more of the associated listed items.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as the elements and features are illustrated and oriented in the figures. Unless otherwise specified, the spatially relative terms are intended to encompass different orientations of the materials in addition to the orientation depicted in the figures.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter).

As used herein, the term "earth-boring tool" means and includes any type of bit or tool used for drilling during the formation or enlargement of a wellbore and includes, for example, rotary drill bits, percussion bits, core bits, eccentric bits, bi-center bits, reamers, mills, drag bits, roller-cone bits, hybrid bits, and other drilling bits and tools known in the art.

FIG. 1 is a perspective view of an earth-boring tool 100 in its normal orientation during drilling operations according to embodiments of the present disclosure. The earth-boring tool 100 may be a hybrid bit (e.g., a drill bit having both roller cones and fixed blades) as illustrated in FIG. 1, or the earth-boring tool 100 may comprise a conventional roller cone bit (e.g., a drill bit having only roller cones). Furthermore, the earth-boring tool 100 may comprise any other drill bit or earth-boring tool including one or more rotatable cutting structures for use in drilling and/or enlarging a borehole in a subterranean formation.

As illustrated in FIG. 1, the earth-boring tool 100 comprises a tool body 102 having a central axis 104 defining an axial center of the tool 100 about which the tool 100 is rotated during drilling operations. The central axis 104 may extend in a direction hereinafter referred to as an "axial direction." The tool body 102 includes a shank 106, which is threaded or otherwise configured for coupling the tool 100 to a drill string (not shown), and a crown 108 on a side of the tool body 102 opposite the shank 106. In some embodiments, the tool body 102 may be formed of a metal or metal alloy, such as steel. In other embodiments, the tool body 102 may comprise a cermet material (i.e., a ceramic-metal composite material) including particles of a hard material (e.g., tungsten carbide) cemented within a metal matrix material. The tool body 102 may be provided with a wear and/or abrasion resistance coating 113, such as a tungsten carbide coating.

The crown 108 may comprise a plurality of nozzle ports 110 provided within the fluid channels 112 for communicating drilling fluid from an interior of the tool body 102 to a bit face surface. The crown 108 may also comprise at least one blade 116 and at least one rotatable cutting structure assembly 118. As illustrated in FIG. 1, the crown 108 includes a plurality of blades 116 and a plurality of rotatable cutting structure assemblies 118. In some embodiments, at least one blade 116 may be located between adjacent rotatable cutting structure assemblies 118. In other embodiments, multiple blades 116 may be located between adjacent rotatable cutting structure assemblies 118. In yet other embodiments, the blades 116 and rotatable cutting structure assemblies 118 may be located in any other configuration.

Each blade 116 may extend in the axial direction and in a radial direction across the bit face surface (e.g., outwardly from the central axis 104). Each blade 116 may have multiple profile regions, including a cone region, nose region, shoulder region, and gage region as known in the art. A plurality of cutting elements 117 may be mounted to each blade 116 in one or more of the profile regions. The cutting elements 117 may comprise a table of polycrystalline diamond (PCD) or other superabrasive material on a rotationally leading face of a supporting substrate of tungsten carbide or other hard material. The PCD layer or table may provide a cutting face having a cutting edge at a periphery thereof for engaging a subterranean formation. The cutting elements 117 may be secured in recesses or pockets in the blade 116 such that the cutting edge engages the subterranean formation to shear and/or remove formation material therefrom when the tool 100 is rotated about the central axis 104 during drilling operations.

Each rotatable cutting structure assembly 118 may comprise a leg 120 extending from the tool body 102 in the axial direction. In embodiments of the present disclosure, the blades 116 and the legs 120 may be integrally formed with the tool body 102. Put differently, the blades 116, the legs 120, and the tool body 102 may form a unitary body such that the blades 116 and the legs 120 are not separable from the tool body 102 by non-destructive means.

The rotatable cutting structure assembly 118 further comprises a roller cone 122 rotatably mounted on each respective leg 120. Each roller cone 122 may comprise a plurality of rotatable cutting structures 124 mounted thereon. The cutting structures 124 may be randomly distributed about an exterior surface of the roller cone 122 or may be generally arranged in circumferential rows about the exterior surface of the roller cone 122. In some embodiments, the cutting structures 124 may comprise preformed inserts secured in recesses or pockets formed in the roller cone 122. Such preformed inserts may comprise a PCD layer or other superabrasive material thereon. In other embodiments, the cutting structures 124 may comprise teeth integrally formed with the roller cone 122. The cutting structures 124 may crush or penetrate the subterranean formation to fail and remove formation material therefrom when the tool 100 is rotated about the central axis 104 during drilling operations and the roller cone 122 rotates about its axis.

Figure 2:
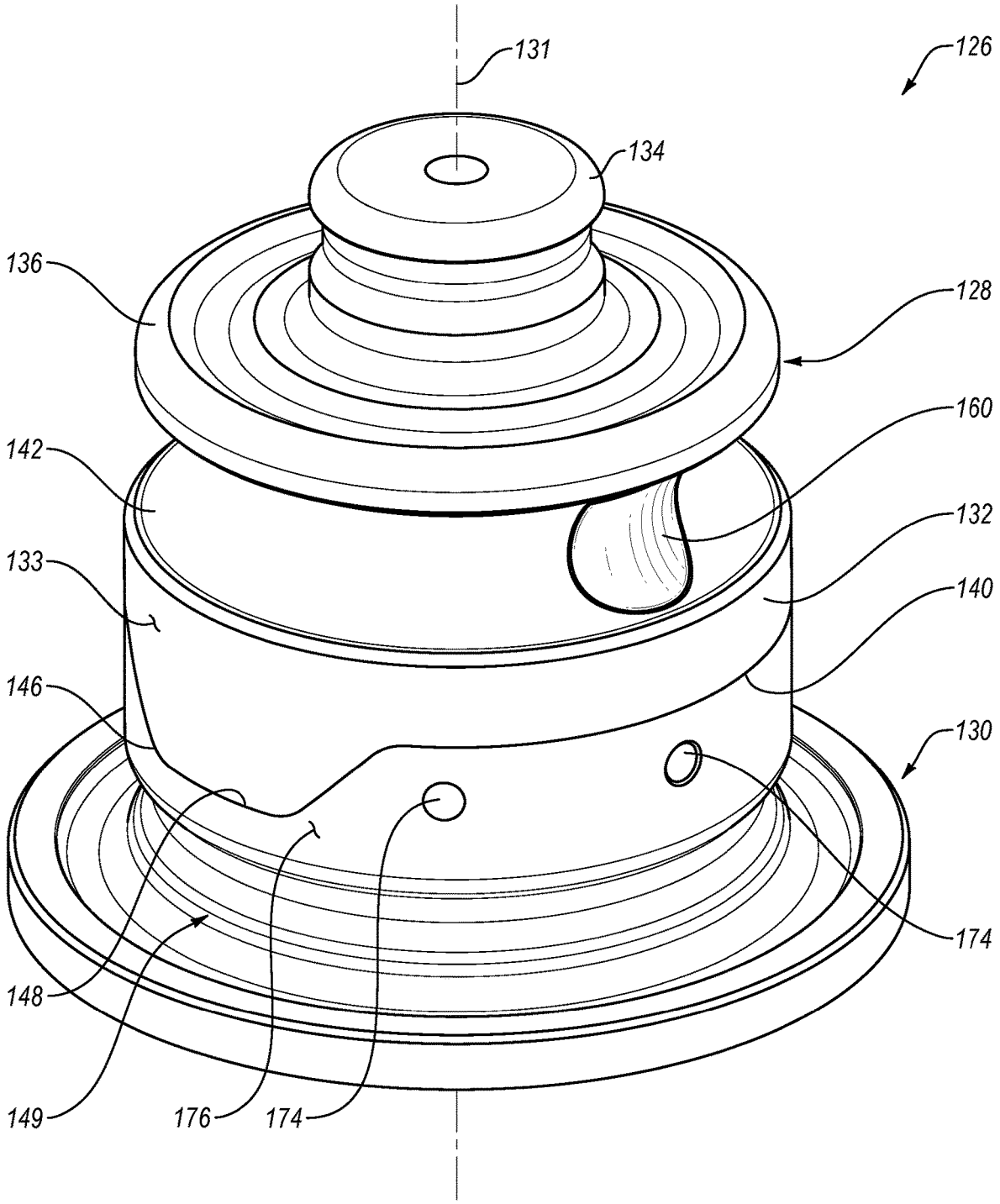
FIG. 2 is a perspective view of the roller cone bearing assembly of the earth-boring tool of FIG. 1.
Figure 3:
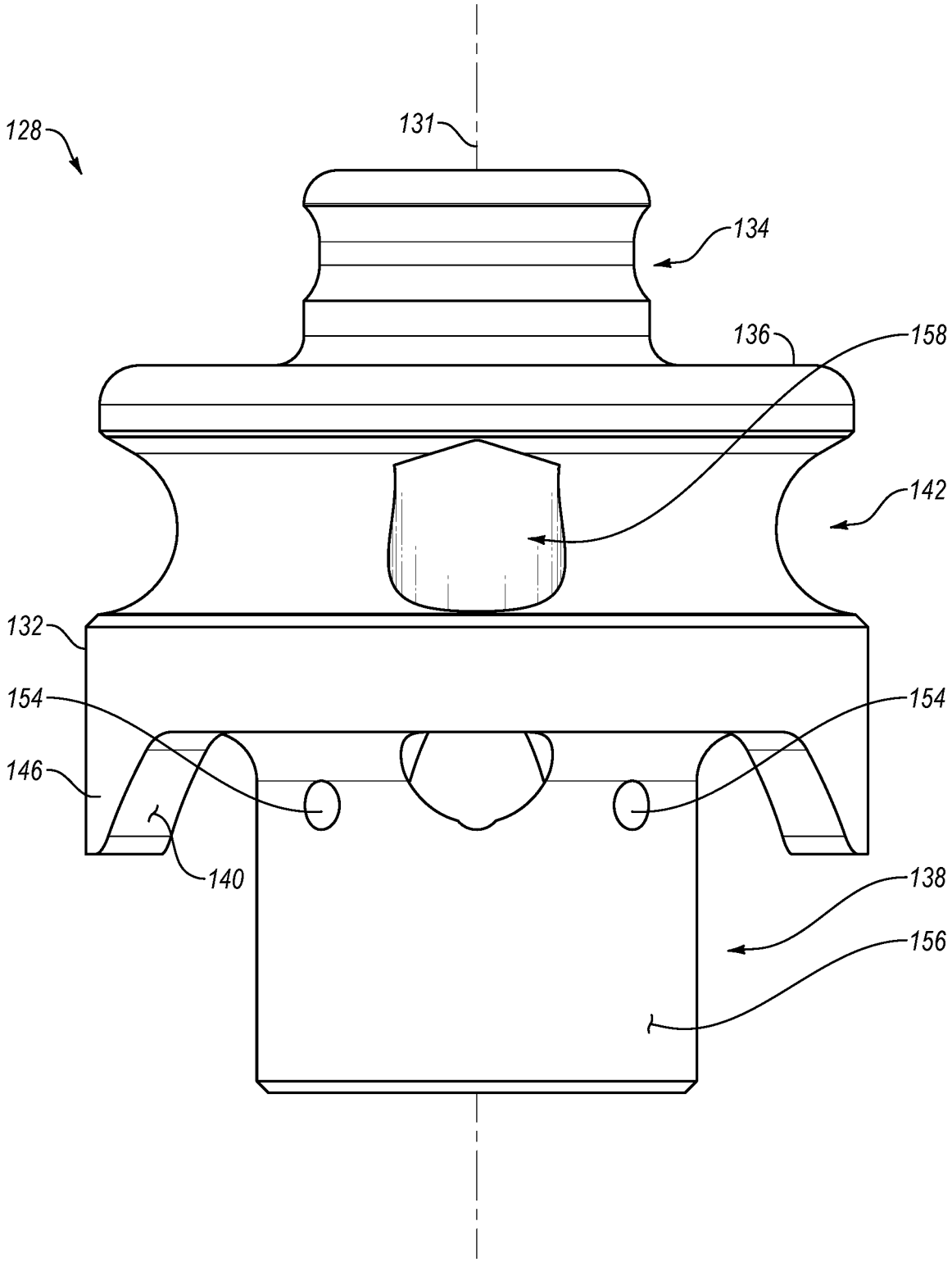
FIG. 3 is a side view of a bearing shaft of the roller cone bearing assembly of FIG. 2.
Figure 4:
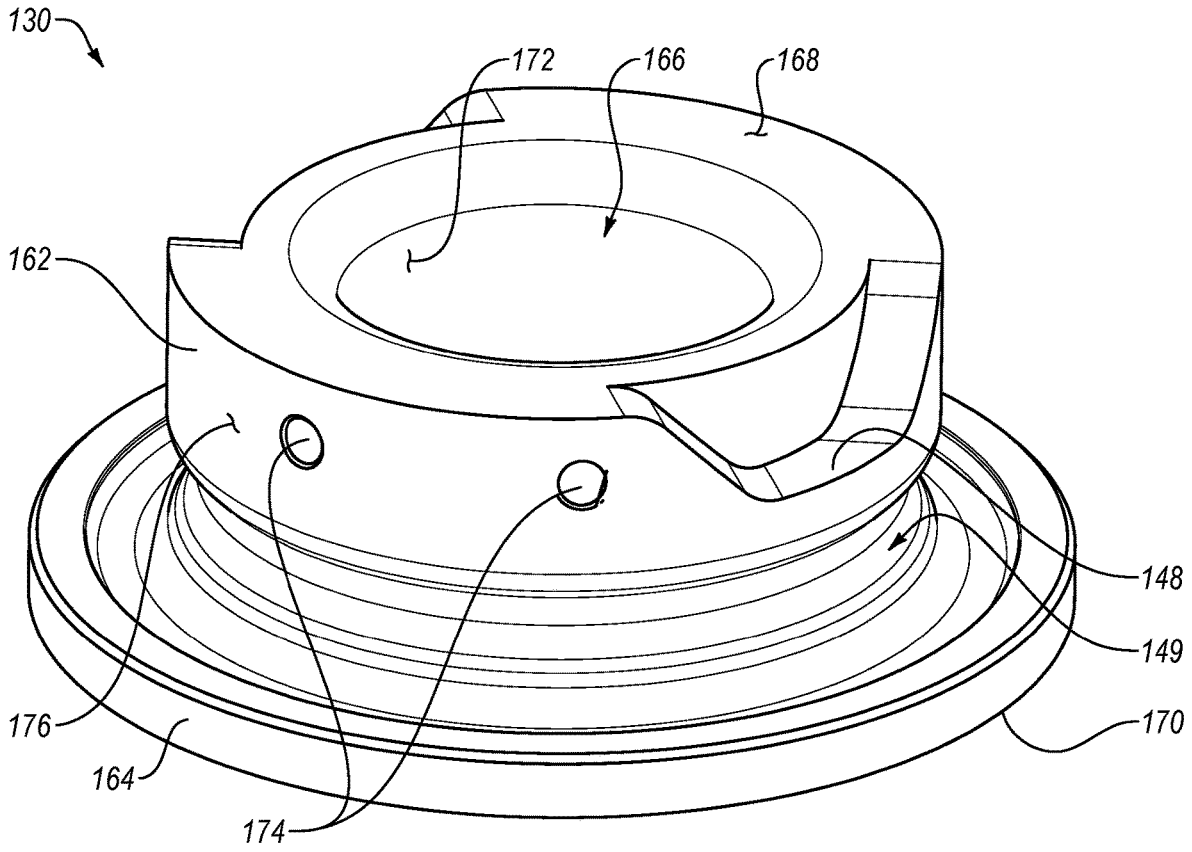
FIG. 4 is a perspective view of a base member of the roller cone bearing assembly of FIG. 2.
Figure 5:
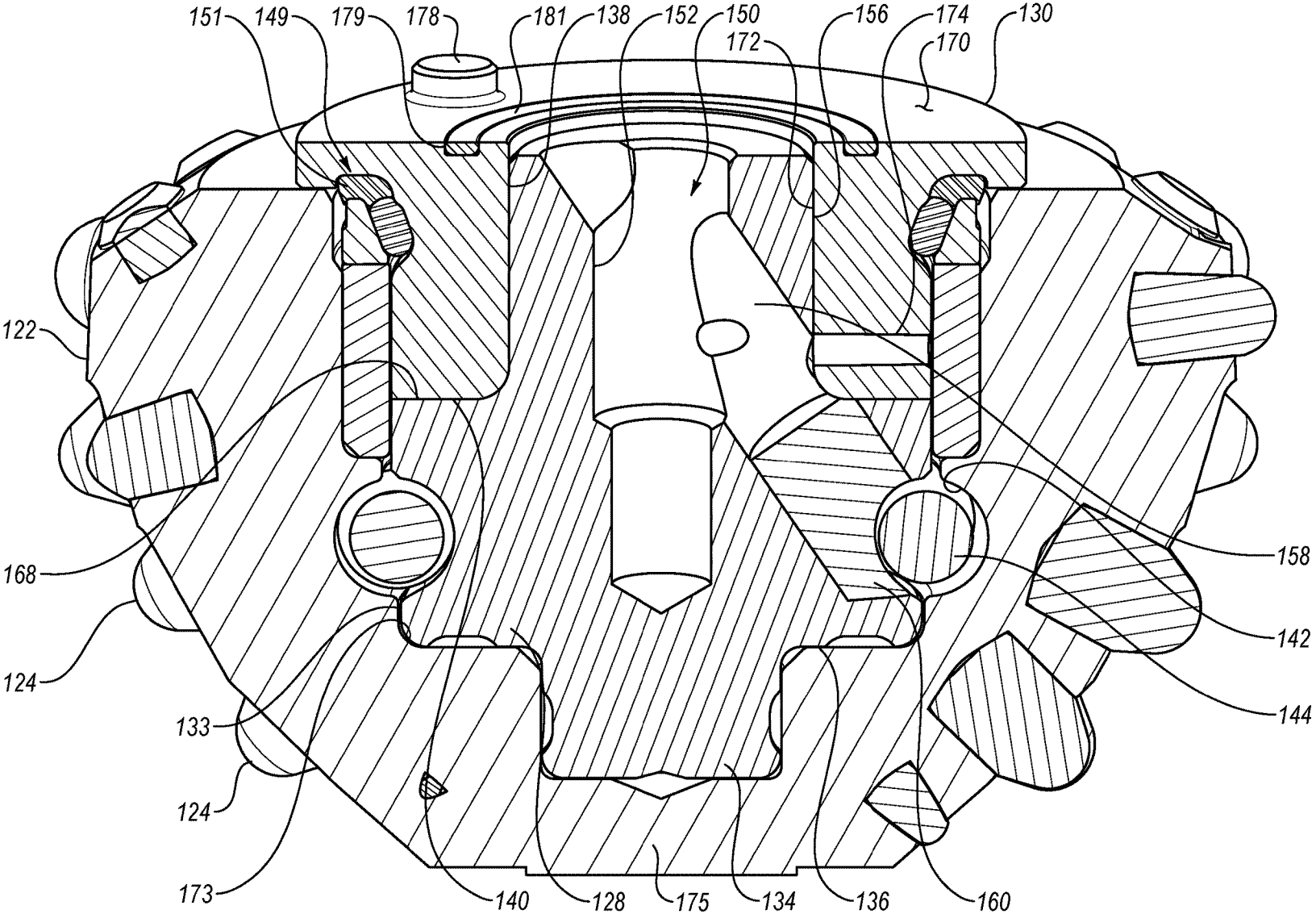
FIG. 5 is a cross-sectional view of the roller cone bearing assembly and a roller cone attached thereto.

The rotatable cutting structure assembly 118 comprises a roller cone bearing assembly 126, as illustrated in FIGS. 2-6, to mount each roller cone 122 on each respective leg 120. FIG. 2 is a perspective view of the bearing assembly 126. The bearing assembly 126 comprises a bearing shaft 128 and a base member 130, and has a central axis 131 defining an axial center of the bearing assembly 126. The central axis 131 may extend in a direction hereinafter referred to as an "axial direction." FIG. 3 illustrates a side view of the bearing shaft 128, and FIG. 4 illustrates a perspective view of the base member 130. FIG. 5 is a cross-sectional side view of the bearing assembly 126 having the roller cone 122 mounted thereon.

With continued reference to FIGS. 2-5, the bearing shaft 128 comprises a journal pin 132, a pilot pin 134 extending axially (i.e., in the axial direction) beyond an upper surface 136 of the journal pin 132, and an axial extension 138 extending axially beyond a lower surface 140 of the journal pin 132. The journal pin 132, the pilot pin 134, and the axial extension 138 may be integrally formed such that the bearing shaft 128 is a unitary body.

The journal pin 132 may comprise a ball race 142 extending annularly about a generally cylindrical exterior sidewall 133 thereof. The ball race 142 may be sized and configured to receive ball bearings 144 (FIG. 5) therein to facilitate rotation of the roller cone 122 about the bearing assembly 126. In other embodiments, the ball race 142 may be sized and configured to receive a tapered roller bearing or other bearing element to facilitate rotation of the roller cone 122 about the bearing assembly 126.

The journal pin 132 may comprise at least one projection 146. As illustrated in FIG. 3, the journal pin 132 comprises two projections 146 circumferentially and angularly spaced apart from one another about the central axis 131 by about 180°. In other embodiments, the journal pin 132 may comprise any number of projections 146 circumferentially and angularly spaced apart from one another about the central axis 131 by an equal distance such that the projections 146 are regularly distributed about the central axis 131 or by an unequal distance such that the projections 146 are irregularly distributed about the central axis 131. The projections 146 extend axially toward the base member 130 and are sized and configured to be received within respective slots 148 of the base member 130. As best illustrated in FIG. 2, the slots 148 and the projections 146 have complementary (e.g., reciprocal) shapes. In some embodiments, the slots 148 and projections 146 may have the shape of an isosceles trapezoid. In other embodiments, the slots 148 and projections 146 may have any other shape configured to prevent relative rotation of (e.g., interlock) the bearing shaft 128 and the base member 130 during operation of the bearing assembly 126.

The bearing shaft 128 may further comprise a cavity 150 (FIG. 5) formed therein. The cavity 150 may extend axially through at least a portion of the bearing shaft 128, such as through the axial extension 138 and the journal pin 132. The cavity 150 may be defined by an interior sidewall 152 of the bearing shaft 128. The cavity 150 is sized and configured to receive a mechanical fastener therein for coupling the bearing assembly 126 to the leg 120, as explained in further detail with reference to FIG. 6.

The bearing shaft 128 may further comprise at least one aperture 154 extending radially through the axial extension 138 between the interior sidewall 152 and a generally cylindrical exterior sidewall 156 thereof. As illustrated in FIG. 3, the bearing shaft 128 comprises two apertures 154 circumferentially and angularly spaced apart from one another about the central axis 131. The apertures 154 may be formed to provide fluid flow between the interior sidewall 152 and the exterior sidewall 156 as explained in further detail below. The bearing shaft 128 may further comprise an aperture 158 extending between the interior sidewall 152 and the ball race 142. As explained with reference to FIG. 5, the aperture 158 is sized and configured for installation of ball bearings 144 in the ball race 142. A ball plug 160 may be received within the aperture 158 to retain the ball bearings 144 in the ball race 142.

The base member 130 may comprise a main body portion 162 and a flange 164 extending radially beyond the main body portion 162. The main body portion 162 and flange 164 may be integrally formed such that the base member 130 is a unitary body. An aperture 166 may extend axially through the base member 130 between an upper surface 168 and a lower surface 170 thereof. The aperture 166 is sized and configured to receive the axial extension 138 of the bearing shaft 128 therein to form the bearing assembly 126 as illustrated in FIG. 5. The aperture 166 may be defined by an interior sidewall 172 that encircles the exterior sidewall 156 of the axial extension 138.

The base member 130 may comprise at least one aperture 174 extending between the interior sidewall 172 and a generally cylindrical exterior sidewall 176 of the main body portion 162. As illustrated in FIG. 4, the base member 130 comprises two apertures 174 circumferentially and angularly spaced apart from one another about the central axis 131. The apertures 174 may be formed to provide fluid flow between the interior sidewall 172 and the exterior sidewall 176 as explained in further detail below.

The base member 130 may comprise at least one slot 148. In some embodiments, the slot 148 may be formed in the exterior sidewall 176 of the main body portion 162 proximate to the upper surface 168. In other embodiments, the slot 148 may be formed in the interior sidewall 172 of the main body portion 162 proximate to the upper surface 168. As illustrated in FIG. 4, the base member 130 comprises two slots 148 circumferentially and angularly spaced apart from one another about the central axis 131 by about 180°. In other embodiments, the base member 130 may comprise any number of slots 148 circumferentially and angularly spaced apart from one another about the central axis 131 by an equal distance such that the slots 148 are regularly distributed about the central axis 131 or by an unequal distance such that the slots 148 are irregularly distributed about the central axis 131. The number and placement of the slots 148 corresponds to the number and placements of the projections 146 to be received therein.

The base member 130 may also comprise an annular groove 149 extending circumferentially about the exterior sidewall 176. The annular groove 149 may be formed (e.g., located) proximate to the flange 164. The annular groove 149 is sized and configured to receive a sealing element 151 (FIG. 5) therein. The sealing element 151 may comprise a resilient or elastomeric material, such as an O-ring, a mechanical face seal, or any other seal component. The sealing element 151 may prevent fluid flow between two components of the bearing assembly 126 and the roller cone 122.

As illustrated in FIG. 5, the lower surface 170 of the base member 130 may further comprise at least one boss 178 extending therefrom and an annular groove 179 formed therein. The annular groove 179 is sized and configured to receive a sealing element 181 therein. The sealing element 181 may comprise a resilient or elastomeric material, such as an O-ring, a mechanical face seal, or any other seal component to prevent fluid flow between two components.

With reference to FIGS. 2 and 5, the bearing shaft 128, the base member 130, and the roller cone 122 may be assembled together prior to being removably coupled to the leg 120. In some embodiments, the bearing assembly 126 and the roller cone 122 may be removably coupled to each other. The roller cone 122 may comprise a cavity 173 formed in a roller cone body 175. The cavity 173 may be sized and shaped for receiving the bearing shaft 128 and the base member 130 therein and to facilitate (e.g., allow) rotation of the roller cone 122 about the bearing assembly 126 and relative to the leg 120. To form the assembly, the bearing shaft 128 may be provided within the roller cone body 175 such that the cylindrical exterior sidewall 133 of the journal pin 132 and the exterior sidewall and face of the pilot pin 134 abut against interior surfaces of the roller cone body 175 defining the cavity 173. In some embodiments, exterior surfaces of the bearing assembly 126 and/or interior surfaces of the roller cone body 175 may be provided with a wear resistant coating, such as a diamond-like carbon coating or any other coating material having a low coefficient of friction, to reduce wear on the bearing assembly 126 and the roller cone body 175 as the roller cone 122 rotates about the bearing assembly 126 in operation. After placement of the roller cone 122 on the bearing assembly 126, ball bearings 144 may be provided through the apertures 154, 158 into the ball race 142. The ball plug 160 may be provided in the aperture 158 and retains the ball bearings 144 in the ball race 142.

The base member 130 may be provided in the cavity 173 to abut against the bearing shaft 128 therein. When the base member 130 is installed, the upper surface 168 of the base member 130 abuts against the lower surface 140 of the journal pin 132 and against a portion of the ball plug 160 to retain the ball plug 160 in the aperture 158. Further, the axial extension 138 is received within the aperture 166 of the base member 130 such that the interior sidewall 172 encircles and abuts against the exterior sidewall 156 of the axial extension 138, and the projections 146 of the journal pin 132 are received in the slots 148 of the base member 130. In addition, the apertures 154, 174 may be aligned to provide fluid flow between the cavity 150 and an interface between interior surfaces of the roller cone body 175 and exterior surfaces of the base member 130 and bearing shaft 128. One or more additional sealing elements may be provided about the base member 130 to prevent drilling fluid flow exiting the nozzle ports 110 and debris from passing between the roller cone 122 and the base member 130. The sealing element 151 is provided in the annular groove 149. In some embodiments, the bearing assembly 126 and the roller cone 122 may be assembled together prior to mounting the assembly to the leg 120.

By forming the bearing assembly 126 separately from the leg 120 of the tool body 102, the bearing assembly 126 and the tool body 102 may be made from different materials particularly formulated to meet the different functional properties thereof. The materials of the tool body 102 may be selected to provide a desirable degree of toughness (e.g., resistance to impact-type fracture), wear and abrasion resistance (e.g., resistance to erosion from drilling fluid flow and abrasion with the subterranean formation material), hardness, and other properties necessary for formation or enlargement of a wellbore. As previously described herein, the tool body 102 may comprise a steel or matrix body. The materials of the bearing assembly 126 may be selected to limit wear and erosion of the base member 130 and the bearing shaft 128 due to rotational engagement with the roller cone 122 rotationally mounted thereon. In some embodiments, the bearing assembly 126 may be selected to comprise a high performance bearing steel. For example, the bearing assembly 126 may be selected to comprise CARTECH® 52100 alloy steel or CARTECH® M-50 bearing steel, which are each manufactured by Carpenter. Furthermore, as the bearing assembly 126 is a separable component that is removable from the leg 120 by non-destructive means, the bearing assembly 126 may be readily removed and replaced or refurbished upon wear. As a result, the bearing assembly 126 may be replaced at a lesser cost than replacing each of the leg 120 and the bearing assembly 126 as in conventional bits in which the leg and at least a portion of the bearing assembly for the roller cone 122 are integrally formed.

Figure 6:
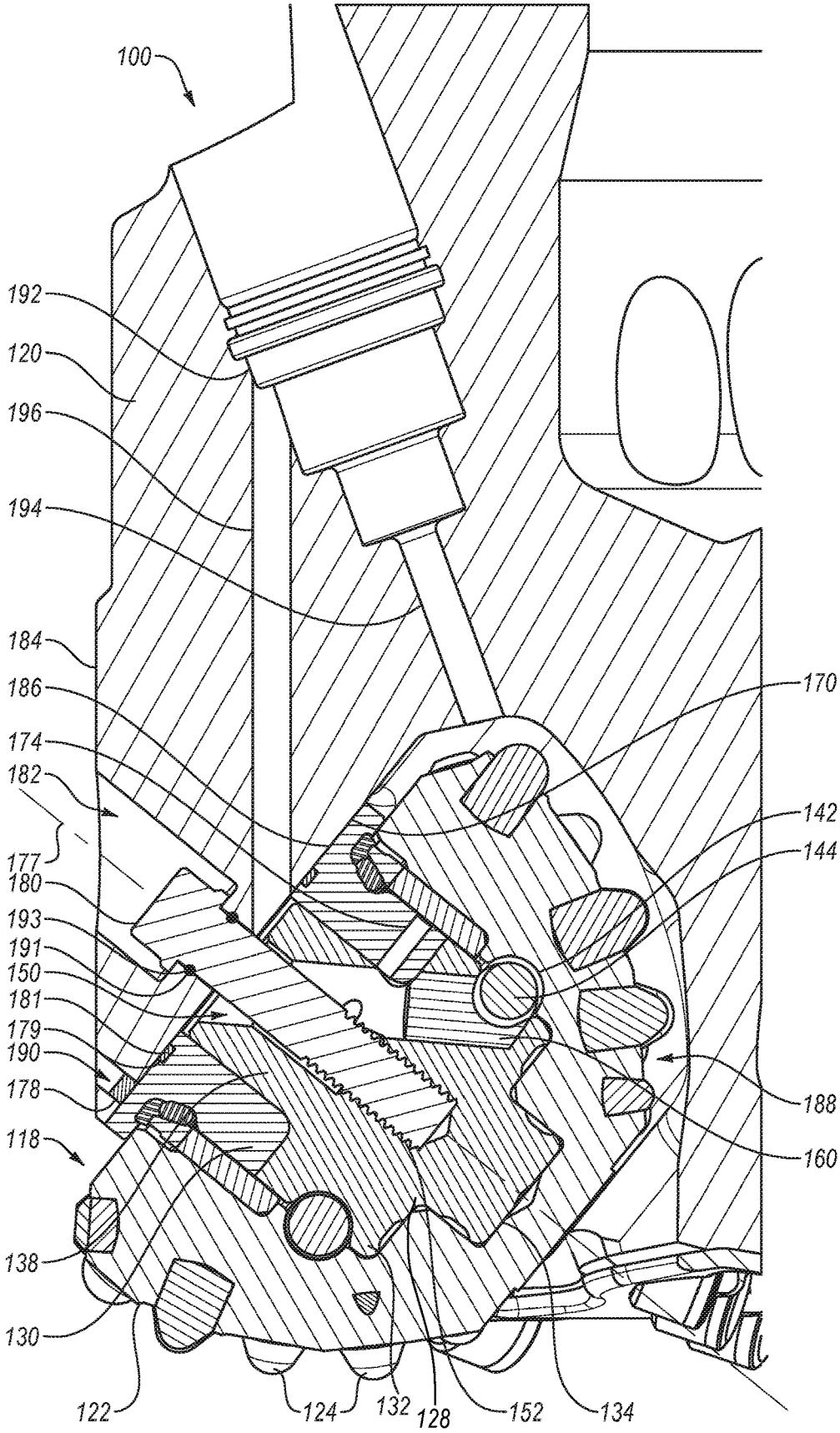
FIG. 6 is a partial, cross-sectional side view of the earth-boring tool of FIG. 1.

FIG. 6 illustrates a partial cross-sectional view of the leg 120 having the bearing assembly 126 and the roller cone 122 rotatably mounted (e.g., affixed) thereon. In some embodiments, the bearing assembly 126 may be cantilevered from the leg 120 and may extend downwardly and inwardly toward the central axis 104 of the tool body 102. When the roller cone 122 is mounted to the leg 120, the rotational axis 177 of the roller cone 122 may be coaxial with the central axis 131 of the bearing assembly 126. The roller cone 122 and the bearing assembly 126 may be oriented on the leg 120 such that the rotational axis 177 extends generally toward the central axis 104 of the tool body 102 at an acute angle. In some embodiments, the roller cone 122 and the bearing assembly 126 may be oriented on the leg 120 such that the rotational axis 177 intersects the central axis 104. In other embodiments, the roller cone 122 and the bearing assembly 126 may be oriented on the leg 120 such that the rotational axis 177 extends away from the central axis 104.

The bearing assembly 126 and the roller cone 122 may be received within a cavity 188 defined by the tool body 102, including a planar, interior surface 186 of the leg 120. To affix the bearing assembly to the leg 120, the lower surface 170 of the base member 130 abuts against the interior surface 186 of the leg 120. The sealing element 181 in the annular groove 179 may abut against the interior surface 186 and prevent drill fluid flow exiting the nozzle ports 110 and debris from passing between the base member 130 and the leg 120.

A mechanical fastener 180 may be provided to affix the bearing shaft 128 of the bearing assembly 126 to the leg 120. The mechanical fastener 180 provided within an aperture 182 formed through the leg 120 and into the cavity 150 of the bearing shaft 128. The aperture 182 extends between an exterior surface 184 and the interior surface 186 of the leg 120. In some embodiments, the aperture 182 extends angularly between the exterior surface 184 and the interior surface 186 such that a central axis of the aperture 182 may be coaxial with the rotational axis 177 of the roller cone 122. The aperture 182 may comprise a counterbore adjacent the interior surface 186 of the leg 120 against which a head of the mechanical fastener 180 abuts upon installation. The aperture 182 may also comprise an annular groove 191 formed in the body of the leg 120. The annular groove 191 is sized and configured to receive a sealing element 193 therein. The sealing element 193 may comprise a resilient or elastomeric material, such as an O-ring or any other seal component to prevent fluid flow between two components. The sealing element 193 may prevent drill fluid flow exiting the nozzle ports 110 (FIG. 1) and debris from passing between the mechanical fastener 180 and the aperture 182 and into the cavity 150 of the bearing shaft 128.

In some embodiments, the mechanical fastener 180 may comprise a threaded fastener. In such embodiments, a portion of the interior sidewall 152 of the cavity 150 of the bearing shaft 128 may be threaded, as illustrated in FIG. 6, such that the threaded fastener engages threads of the cavity 150 to couple the bearing shaft 128 to the leg 120. The head of the mechanical fastener 180 abut against the counterbore. In some embodiments, the aperture 182 may be provided with a filler material 183 (FIG. 1), such as an epoxy, to inhibit removal of the mechanical fastener 180 from the aperture 182 during drilling operations. In other embodiments, the mechanical fastener 180 may be also be removably affixed within the aperture 182 by appropriate attachment means including, but not limited to, brazing, welding, adhesives, and the like. The mechanical fastener 180 may comprise, for example, a nickel-based alloy, a stainless steel, chromium-molybdenum alloy, or other high strength steels having a strength sufficient to withstand a bending moment exerted thereon by engagement of the roller cone 122 with the subterranean formation during operation.

The bearing assembly 126 may further be removably coupled to the leg 120 by providing the boss 178 of the base member 130 within an aperture 190 of the leg 120. The aperture 190 may extend between the exterior surface 184 and the interior surface 186 of the leg 120. Like the aperture 182, the aperture 190 may extend angularly through the leg 120 and may comprise a counterbore. The number and placement of the apertures 190 corresponds to the number and placement of the boss 178 on the lower surface 170 of the base member 130 to be received therein. A central axis of the aperture 190 may extend parallel to the rotational axis 177 of the roller cone 122. In some embodiments, the boss 178 may be secured in the aperture 190 by compression fit, interference fit, press fit, and the like. In other embodiments, the boss 178 may be secured in the aperture 190 by brazing, welding, adhesives, and the like. In some embodiments, the aperture 190 may be provided with threading configured to engage a tool intended to force the boss 178 out of the aperture 190 for removal and repair of the bearing assembly 126. In other embodiments, the boss 178 may be removed from the aperture 190 for replacement or repair by drilling out the welding or brazing material.

In other embodiments, the bearing assembly 126 may be removably coupled to the leg 120 by a tensioner bolt and nut as described, for example, in U.S. Patent Pub. 2017/0241208, entitled "Bearings for Downhole Tools, Downhole Tools Incorporating Such Bearings, and Related Methods," filed Feb. 18, 2016, and/or U.S. Patent Pub. 2017/0241209, entitled "Bearings for Downhole Tools, Downhole Tools Incorporating Such Bearings, and Related Methods," filed Feb. 10, 2017, the disclosure of each of which is hereby incorporated in its entirety by this reference. In such embodiments, the bearing shaft 128 may comprise an aperture extending completely therethrough in place of the cavity 150 as illustrated in FIG. 5. In operation, the bearing assembly 126 remains stationary relative to the leg 120. More particularly, engagement of the boss 178 with the aperture 190 may fix rotational movement of the base member 130 relative to the leg 120, and engagement of the projections 146 of the bearing shaft 128 with the slots 148 of the base member 130 may fix rotational movement of the bearing shaft 128 relative to the base member 130 and the leg 120.

The tool body 102 may further comprise a pressure compensating lubrication system 192 within each leg 120. A lubricant passageway 194 may extend through the leg 120 between the lubrication system 192 and the cavity 188. Another lubricant passageway 196 may extend through the leg 120 from the lubrication system 192 to the interior surface 186 of the leg 120. Lubrication may be provided through the lubricant passageway 196 to the interior surface 186, into the cavity 150 of the bearing shaft 128, through the aperture 154 of the bearing shaft 128, through the aperture 174 of the base member 130, and between surfaces defining the cavity 173 in the roller cone 122 and exterior surfaces of the bearing assembly 126. The sealing element 151 may inhibit lubrication from the lubricant passageway 196 from being removed from this flow path. Lubrication may facilitate rotation of the roller cone 122 about the bearing assembly 126 by providing lubrication between the bearing assembly 126, the ball bearings 144, and interior surfaces of the roller cone 122 and may aid in removing heat generated by rotation of the roller cone 122 about the bearing assembly 126 and by the ball bearings 144.

While the present disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the invention as claimed, including legal equivalents thereof. In addition, features from one embodiment may be combined with features of another embodiment while still being encompassed within the scope of the invention. Further, embodiments of the disclosure have utility with different and various tool types and configurations.

What is claimed is:

1. An earth-boring tool for removing subterranean formation material in a borehole, comprising:

a tool body having a central axis defining an axial center thereof;

a leg extending in an axial direction from the tool body;

a bearing assembly removably coupled to the leg, the bearing assembly comprising:

a bearing shaft; and a base member encircling a portion of the bearing shaft, the base member abutting against a surface of the leg, wherein an interface between the bearing shaft and the base member is configured to substantially prevent relative rotation between the bearing shaft and the base member; and a roller cone rotatably coupled to the bearing assembly and having a rotational axis about which the roller cone rotates on the bearing assembly when the roller cone removes subterranean formation material in the borehole.

2. The earth-boring tool of claim 1, wherein:

the leg comprises an aperture extending therethrough; and the bearing assembly is removably coupled to the leg by a mechanical fastener, the mechanical fastener extending through the aperture and into a cavity formed in the bearing shaft.

3. The earth-boring tool of claim 2, wherein each of a central axis of the mechanical fastener and a central axis of the aperture is coaxial with the rotational axis of the roller cone.

4. The earth-boring tool of claim 1, wherein the bearing shaft comprises a journal pin, a pilot pin extending axially from the journal pin, and an axial extension extending axially from the journal pin on a side of the journal pin opposite the pilot pin.

5. The earth-boring tool of claim 1, wherein the base member comprises a main body portion and a flange extending radially beyond an exterior sidewall of the main body portion.

6. The earth-boring tool of claim 1, wherein the bearing shaft comprises at least one projection and the base member comprises at least one slot, and wherein the at least one projection is received in the at least one slot to prevent rotational movement of the bearing shaft relative to the base member when the bearing assembly is removably coupled to the at least one leg.

7. The earth-boring tool of claim 1, wherein the bearing shaft comprises an axial extension and the base member comprises an aperture extending therethrough, and wherein the axial extension is disposed in the aperture such that an inner sidewall of the aperture of the base member encircles the axial extension of the bearing shaft when the bearing assembly is removably coupled to the leg.

8. The earth-boring tool of claim 1, wherein the base member comprises a boss on a lower surface thereof abutting against the leg, and the leg comprises an opening, and wherein the boss is disposed in the opening to prevent rotational movement of the base member relative to the leg when the bearing assembly is removably coupled to the leg.

9. The earth-boring tool of claim 8, wherein the boss is secured in the opening of the leg by one of an interference fit, a compression fit, and a press fit.

10. The earth-boring tool of claim 1, further comprising a fixed blade integrally formed with the tool body.

11. The earth-boring tool of claim 1, wherein the leg is integrally formed with the tool body.

12. A rotatable cutting structure assembly, comprising:

a bearing assembly separable from a tool body of an earth-boring tool comprising:

a bearing shaft; and a base member encircling a portion of the bearing shaft, the base member separable from the bearing shaft, wherein an interface between the bearing shaft and the base member is configured to substantially prevent relative rotation between the bearing shaft and the base member; and a roller cone rotatably coupled to the bearing assembly and having a rotational axis about which the roller cone rotates on and about the bearing assembly.

13. The rotatable cutting structure assembly of claim 12, wherein:

the bearing shaft comprises a journal pin, a pilot pin extending axially from the journal pin, and an axial extension extending axially from the journal pin on a side of the journal pin opposite the pilot pin; and the base member comprises a main body portion and a flange extending radially beyond an exterior sidewall of the main body portion.

14. The rotatable cutting structure assembly of claim 13, wherein:

the journal pin of the bearing shaft comprises at least one projection;

the main body portion of the base member comprises at least one slot; and the at least one projection is received in the at least one slot to interlock the bearing shaft and the base member.

15. The rotatable cutting structure assembly of claim 13, wherein:

the base member comprises an aperture extending therethrough; and the axial extension of the bearing shaft is disposed in the aperture such that the base member encircles the bearing shaft.

16. The rotatable cutting structure assembly of claim 13, wherein the journal pin comprises a bearing raceway extending about a circumference thereof, the bearing raceway configured to receive ball bearings therein to facilitate rotation of the roller cone about the bearing assembly.

17. The rotatable cutting structure assembly of claim 13, wherein a body of the roller cone comprises a cavity formed therein and defined by interior surfaces of the body of the roller cone, the interior surfaces of the body of the roller cone abutting against exterior surfaces of the journal pin and the pilot pin of the bearing shaft and abutting against exterior surfaces of the main body portion and the flange of the base member.

18. A method of assembling a rotatable cutting structure assembly on an earth-boring tool, comprising:

abutting a base member of a bearing assembly against a planar interior surface of a leg extending from a tool body, the base member comprising an aperture extending therethrough;

disposing at least a portion of a bearing shaft of the bearing assembly within the aperture of the base member, the bearing shaft comprising a cavity formed therein, wherein an interface between the bearing shaft and the base member is configured to substantially prevent relative rotation between the bearing shaft and the base member;

coupling the bearing shaft to the leg by disposing a mechanical fastener through an aperture formed through the leg of the tool body between an exterior surface and the interior surface thereof and into the cavity of the bearing shaft; and disposing a roller cone on the base member and the bearing shaft.

19. The method of claim 18, further comprising disposing a boss formed on a lower surface of the base member into at least one other aperture formed through the leg of the tool body between the exterior surface and the interior surface thereof, the lower surface of the base member abutting against the interior surface of the leg.

20. The method of claim 18, further comprising interlocking the bearing shaft and the base member by disposing at least one projection of the bearing shaft within at least one slot of the base member, the at least one projection and the at least one slot having complementary shapes.

* * * * *